US012497252B2

(12) United States Patent
Hobmeier et al.

(10) Patent No.: US 12,497,252 B2
(45) Date of Patent: Dec. 16, 2025

(54) DEVICE AND METHOD FOR SEPARATING VALUE DOCUMENTS, IN PARTICULAR BANKNOTES, AND VALUE DOCUMENT PROCESSING SYSTEM

(71) Applicant: GIESECKE+DEVRIENT CURRENCY TECHNOLOGY GMBH, Munich (DE)

(72) Inventors: Ralf Hobmeier, Munich (DE); Richard Neuhauser, Baldham (DE); Bernhard Schneiderbauer, Munich (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 78 days.

(21) Appl. No.: 18/568,952

(22) PCT Filed: May 31, 2022

(86) PCT No.: PCT/EP2022/064823

§ 371 (c)(1),
(2) Date: Dec. 11, 2023

(87) PCT Pub. No.: WO2022/268457

PCT Pub. Date: Dec. 29, 2022

(65) Prior Publication Data

US 2024/0286854 A1 Aug. 29, 2024

(30) Foreign Application Priority Data

Jun. 22, 2021 (DE) ..... 10 2021 003 201.2

(51) Int. Cl.
*B65H 3/06* (2006.01)
*B65H 1/06* (2006.01)

(52) U.S. Cl.
CPC ..... *B65H 3/063* (2013.01); *B65H 1/06* (2013.01); *B65H 2513/11* (2013.01); *B65H 2701/1912* (2013.01)

(58) Field of Classification Search
CPC ..... B65H 3/063; B65H 1/06; B65H 2513/11; B65H 2701/1912
See application file for complete search history.

(56) References Cited

U.S. PATENT DOCUMENTS 5,224,698 A 7/1993 Kobayashi
5,664,786 A * 9/1997 Buschhaus ..... B65H 3/28 271/99

(Continued)

FOREIGN PATENT DOCUMENTS

JP H07251963 A 10/1995
WO 0246074 A1 6/2002

OTHER PUBLICATIONS

International Search Report from corresponding PCT Application No. PCT/EP2022/064823, Sep. 14, 2022.

*Primary Examiner* — Thomas A Morrison
(74) *Attorney, Agent, or Firm* — Workman Nydegger

(57) ABSTRACT

A device for separating value documents, in particular banknotes, includes a receiving device which is designed to receive a stack of value documents, a rotatable separating element which is designed to act temporarily on in each case one value document of the stack and to withdraw the same from the stack, and a drive device which is designed to set the separating element into rotation, and a control device which is designed to control the drive device such that the rotational speed of the rotation, into which the separating element is set by the drive device, is changed, in particular temporarily, during each revolution of the separating ele- (Continued)

ment. A method corresponds to the device and to a value document processing system comprising such a device.

8 Claims, 2 Drawing Sheets

(56) References Cited

U.S. PATENT DOCUMENTS

| | | | | |
|---|---|---|---|---|
| 6,050,563 | A * | 4/2000 | Vedoy | B65H 3/5284<br>271/10.07 |
| 2005/0285321 | A1 * | 12/2005 | Massoud | B65H 3/24<br>271/3.11 |

* cited by examiner

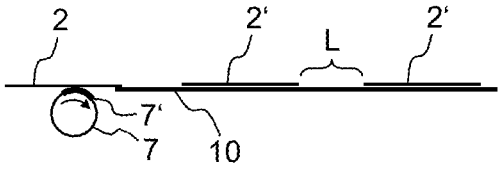
Fig. 2(a)
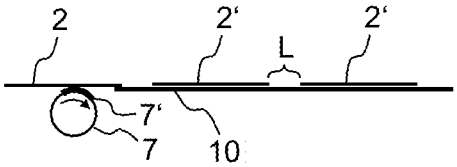
Fig. 2(b)
Fig. 2
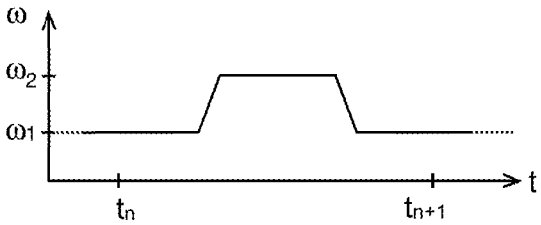
Fig. 3
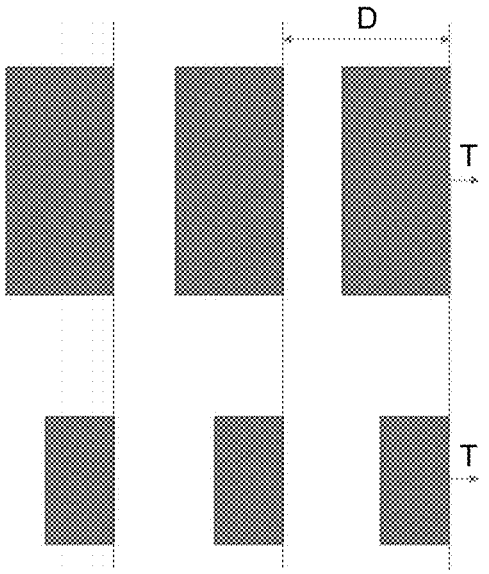
Fig. 4(a)
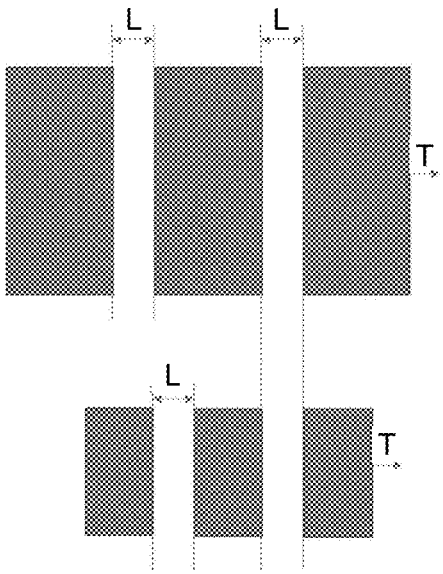
Fig. 4(b)
Fig. 4

DEVICE AND METHOD FOR SEPARATING VALUE DOCUMENTS, IN PARTICULAR BANKNOTES, AND VALUE DOCUMENT PROCESSING SYSTEM

BACKGROUND

The invention relates to a device and to a method for separating value documents, in particular banknotes, and to a system for processing value documents.

In the automatic processing of value documents, in particular banknotes, so-called singlers are usually used in value document processing systems for withdrawing individual value documents from a provided stack of value documents and to feed them to further processing step, such as authenticity and condition checking, counting and sorting.

Various approaches are known for withdrawing value documents from a stack, for example by using friction wheels or rollers, friction belts or by suction or blowing in air. In a so-called friction-wheel singler, a rotating friction element acts in each case during the time interval of one revolution on the relevant value document, generally the bottom or top value document in the stack and withdraws it from the stack.

SUMMARY

One object of the invention is to specify a device and a method for separating value documents, in particular banknotes, and a value document processing system which ensures the most efficient processing of value documents, in particular banknotes possible.

A device for separating value documents, in particular banknotes, according to a first aspect comprises: a receiving device, which is configured to receive a stack of value documents; a rotatable separating element, which is designed to act on a value document of the stack temporarily, in particular periodically, and/or in a specific rotational position, each time and to withdraw it from the stack in the process; a drive device which is configured to rotate the separating element; and a control device which is designed to control the drive device such that the rotational speed of the rotational movement that the separating element is made to perform by the drive device is changed, in particular temporarily, in each case during one revolution of the separating element.

A value document processing system according to a second aspect comprises: one or more devices for processing, in particular transporting, checking, counting and/or sorting, value documents, in particular banknotes; and a device for separating value documents according to the first aspect.

In a method for separating value documents, in particular banknotes, according to a third aspect, a stack of value documents is provided. A rotating separating element acts temporarily, in particular periodically, and/or in a specific rotational position on one value document in the stack each time and withdraws it from the stack. The rotational speed of the rotating separating element is changed during a revolution of the separating element each time, in particular temporarily, in particular depending on a format of the respective value documents.

Aspects of the invention are preferably based on the approach of temporarily changing the rotational speed of the separating element, starting from a rotational speed at which it rotates during a separating process or the withdrawal of a value document from the stack, during one revolution each time, preferably during an in particular short time period between two successive separating processes, and then preferably returning to the original rotational speed. Compared to the case in which the rotational speed of the separating element is maintained during the separating process, even during the rotation between two successive separating processes, the time required for a rotational movement of the separating element between two successive separating processes is thereby changed, in particular shortened or lengthened, in accordance with the temporary change.

The time taken to withdraw the individual value documents from the stack is thereby shortened or lengthened accordingly without there being a need to change the rotational speed of the separating element during the separating process or withdrawal of the relevant value document from the stack. As a result, the individual value documents can, on the one hand, be withdrawn from the stack at a speed (i.e. a track speed resulting from the rotational speed) which substantially corresponds to the transport speed of the value documents in a transport device arranged downstream of the singler, and, on the other hand, the time between the successive separation processes can be shortened or lengthened by the temporary change in the rotational speed during one revolution each time, and thus the time rate or frequency at which the value documents withdrawn each time are transferred to the transport device is increased or reduced.

As a result, the gaps occurring between the successively withdrawn value documents can be reduced as required, for example, so that the throughput of value documents per unit of time in the downstream transport device or processing device is correspondingly increased without there being a need to increase the transport speed. As a result, for example, the gaps that occur between the withdrawn value documents during processing of small-format documents, such as €5 banknote, and are relatively large compared to when processing large-format value documents, such as €100 banknotes, can be reduced in a simple manner, and the throughput can thus be increased without there being a need to increase the transport speed of the value documents in the transport device or processing device. Conversely, the same applies in the case in which the time between two separating processes is increased. Furthermore, it is thereby also possible to keep the gaps occurring between successive value documents, regardless of the respective formats of the value documents, as small as possible, whereby the greatest possible throughput can be achieved for all singled or processed value document formats (high throughput with small formats or lower throughput with larger formats) without there being a need to change the transport speed.

Overall, more efficient processing of value documents, in particular banknotes, is thereby achieved in a simple manner.

The control device is preferably designed to control the drive device in such a way that the rotational speed is temporarily increased and/or reduced during one revolution of the separating element in each case. The rotational speed is preferably increased or reduced only for a short time. Alternatively or additionally, it is also preferred for the control device to be designed to control the drive device in such a way that the separating element rotates at a first rotational speed while the separating element is acting on the corresponding value document and withdrawing it from the stack, and, during one revolution in each case, temporarily rotates at a second rotational speed which is faster or slower than the first rotational speed. In these embodiments, taken in isolation or in combination, the time required for a complete revolution or between two successive separating processes is reliably shortened or lengthened and at the same time it is ensured that the separating element can rotate or is rotating at the first rotational speed provided for withdrawing the corresponding value documents when it is acting on each of the value documents to be withdrawn.

The control device is preferably configured to control the drive device in such a way that the first rotational speed of the separating element is identical or substantially identical for all value documents that have been or are to be withdrawn and/or for all value document formats. In particular, it can thereby be provided that the first rotational speed remains the same even when value documents of different formats are being separated. For example, it can thus be provided that the separating element rotates at the same first rotational speed during the withdrawal of value documents of a smaller format contained in a first stack as during the withdrawal of the value documents of a larger format contained in a subsequently processed second stack.

The separating element is preferably designed to feed each of the value documents withdrawn from the stack to a transport device which is designed to transport the value documents at a transport speed. In this case, the first rotational speed is preferably selected such that the track speed of the separating element while the separating element is acting on the corresponding value document and withdrawing it from the stack is identical or substantially identical to the transport speed. This ensures that the speed of the value documents during their withdrawal from the stack is always matched to the transport speed during subsequent transportation so that a reliable transition between the withdrawal of the corresponding value documents by the separating device and their transportation in the transport device is ensured.

The control device is preferably designed to control the drive device such that the rotational speed of the separating element is periodically changed. The periodic change in the rotational speed of the separating element preferably has a period duration which corresponds to the duration of a complete revolution of the separating element and/or between two successive separating processes in which a value document is withdrawn from the stack each time. The rotational speed during a revolution of the separating element can thereby be temporarily changed in a particularly simple and reliable manner.

It is further preferred that the control device be designed to control the drive device in such a way that the change in the rotational speed of the separating element during a revolution of the separating element each time and/or between two successive separating processes in which a value document is withdrawn from the stack each time, has a sinusoidal, triangular, trapezoidal and/or rectangular time profile. This also makes it possible to provide a temporary change, in particular an increase or decrease, in the rotational speed during a revolution of the separating element in a particularly simple and reliable manner.

The rotational speed of the separating element can be changed several times during one revolution. As a result, the rotational speed can even be increased several times during one revolution, for example, and can even be reduced several times during one revolution.

In particular, the rotational speed of the separating element is adjusted or changed by the control device depending on a format, preferably the dimensions in the transport direction, of the corresponding value document, in particular of the corresponding banknote.

The format of the corresponding value document or the dimensions of the value document in the transport direction can be detected, for example, by a light barrier, in particular a reflective light barrier, or a camera.

The light barrier can, for example, be arranged in an input plate of the device. The camera can, for example, be arranged on the device in such a way that the value documents can be detected from above, i.e. by their main surface, substantially without any distortion.

Furthermore, the rotational speed of the separating element can preferably be changed by the control device additionally or alternatively also on the basis of a trigger switch, for example a turbo button, which can be actuated manually, for example. By means of the trigger switch, an operator of the device can increase the throughput as desired, for example when banknotes with a smaller format than previously are being processed.

The control device can also be supported by artificial intelligence. The detection and classification of the value documents as regards their format can thus be carried out by means of a classifier generated by machine learning. If banknotes with small formats are detected, the separation rate can be increased. If it is detected that the distance between separated banknotes is too short, the separation rate can be reduced.

The device preferably also has a rotatable transport element in addition to the rotatable separating element. The value documents can be transported more reliably into the transport path by the transport element.

The transport element preferably also has a friction element. The friction element of the transport element is thereby preferably designed to only partially rotate about the axis of rotation of the transport element.

In particular, the transport element is formed downstream of the separating element in relation to the transport direction of the value documents, i.e. during operation of the device, the relevant value document comes into contact with the separating element first and then with the transport element.

In particular, the transport element is designed to transport the relevant value document, in particular the relevant banknote, in the direction of the transport path after it has been separated by the separating element. The transport element thereby decides, in particular, the time at which transport of the value document starts or when the value document enters the transport path.

The transport element can additionally be designed having a counterpressure roller. The counterpressure roller is preferably designed without a drive.

The rotational speed of the transport element is preferably equal to or greater than the rotational speed of the separating element in order that the value documents do not get backed up.

The rotational speed of the separating element and the rotational speed of the transport element are preferably changed synchronously. This means in particular that the separating element and the transport element are braked synchronously and/or accelerated synchronously.

The transport element is preferably designed to be driven.

The separating element and the transport element are preferably connected by means of a belt. The rotational speeds can thereby be reliably kept in sync.

BRIEF DESCRIPTION OF THE DRAWINGS

Further advantages, features and possible applications of the present invention can be found in the following description in conjunction with the drawings. In the figures:

FIG. 2, including FIGS. 2(*a*) and 2(*b*), shows in each case an example of a separating element rotating at an a) constant and b) temporarily increased rotational speed, and its effect on the gap between the separated value documents;

FIG. 3 shows an example of a time profile for the rotational speed of the separating element during one revolution; and FIG. 4, including FIGS. 4(*a*) and 4(*b*), shows examples of value documents of different formats separated a) in the conventional manner and b) according to the present disclosure.

DETAILED DESCRIPTION OF THE DRAWINGS

Figure 1:
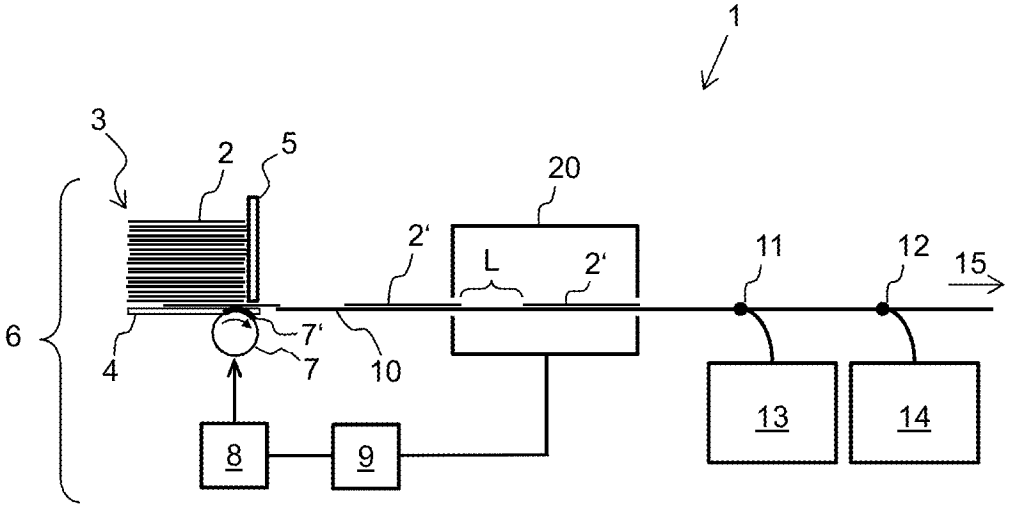
FIG. 1 shows an example of a value document processing system comprising a device for separating value documents.

FIG. 1 is a schematic view of an example of a value document processing system 1 having a device 6 for separating value documents 2, in particular banknotes, provided in the form of a stack 3. For receiving the stack 3, a receiving device is provided which is also referred to as a singler compartment or input compartment and in the present example has a support element 4 which serves as a support for the stack 3, and a stop element 5 which serves as a stop for the edges of the value documents 2 on one side of the stack 3.

Furthermore, a separating element 7 is provided which is designed, for example, as a rotating roller and has a friction element 7T in a region of its circumferential surface, which friction element has greater friction compared to the remaining circumferential surface and/or is increased relative to the remaining circumferential surface. For example, the friction element 7' can be an element made of rubber or plastics which is introduced into or attached to a roller made of metal. In this embodiment of the separating element 7, the device 6 is also referred to as a so-called friction-wheel singler.

Furthermore, a drive device 8, for example an electric motor, is provided, by means of which the separating element 7 can be rotated, as indicated by the curved arrow shown. Depending on the embodiment, the drive device 8 can be coupled to the separating element 7 directly, by means of a transmission or by means of a belt drive.

Possible further elements, for example in the form of one or more further rollers, belts, stripping and/or retaining elements, have been omitted in the present example for reasons of clarity.

In the present example, the support element 4 is designed, and the separating element 7 is arranged, such that the separating element 7 can touch the lowest value document 2 in the stack 3, through the support element 4, by means of the friction element 7' at one or more points. The friction element 7' of the separating element 7, which has been made to rotate, can thereby periodically act on the lowest value document 2 in the stack and thereby withdraw it from the stack 3 and feed it to a transport device 10 which, for reasons of clarity, is shown only in a highly schematic manner.

By means of the transport device 10, the separated value documents 2' are conveyed to a checking device 20, in which they are checked with regard to their properties, such as denomination and/or condition and/or authenticity, and/or are counted. For this purpose, one or more test sensors (not shown) are provided which detect the physical properties of the value documents and convert them into corresponding sensor signals which are evaluated in a control device 9. The control device 9 is also designed to control path switches 11, 12 in such a way that the processed value documents 2 are transferred to a first or second container 13 or 14 depending on the properties determined in each case. Here, for example, value documents 2 in good condition ("fit") are deposited in the first container 13 and value documents 2 in poor condition ("unfit") are deposited in the second container 14. Depending on the application, the value documents 2 can also be deposited in the different containers 13, 14, for example, on the basis of their denomination. Further path switches and further containers (not shown) or further processing elements, such as a shredder for destroying value documents 2 having certain properties, can also be provided, this being indicated by an arrow 15.

The control device 9 is further designed to control the drive device 8 such that the rotational speed of the separating element 7 is temporarily changed, in particular increased or reduced, during one revolution of the separating element 7 in each case. As a result, the gap L occurring in each case between the value documents 2 withdrawn successively from the stack 3 can be reduced or enlarged in a simple and reliable manner, in particular without there being a need to change the transport speed at which the separated value documents 2' are conveyed in the transport device 10. This will be explained in more detail below.

FIG. 2 shows in each case an example of a separating element 7 which is rotating at an a) constant and b) temporarily increased rotational speed and its effect on the gap L between the separated value documents 2'. Due to the rotational speed (angular velocity) of the separating element 7, which is temporarily, in particular briefly, increased during one revolution in each case, the friction element 7' touches the lowest value document 2 in the stack (not shown) after a shorter time span or rotation time than in the case of an unchanged rotational speed. Accordingly, the value documents 2 are withdrawn from the stack at a faster rate (value documents per unit of time) so that the gap L also becomes correspondingly smaller between value documents 2' being successively withdrawn each time.

Preferably, the rotational speed i) is thereby increased only outside or between the successive separating processes, in which the friction element 7' contacts the corresponding value document 2 and thereby withdraws it from the stack, and/or ii) is thereby not increased in the corresponding separating phases during which the friction element 7' contacts the corresponding value document 2 and/or withdraws it from the stack. This ensures that the value document 2 withdrawn in each case is always withdrawn from the stack and fed to the transport device 10 at the same speed. The speed during withdrawal substantially corresponds to the web speed track speed of the separating element 7 or of the friction element 7', which derives from the product of the angular velocity of the separating element 7 or friction element 7' during the separating process and the radius of the separating element 7 or friction element 7'.

FIG. 3 shows an example of a time profile for the rotational speed ω (angular velocity in the unit of revolutions per unit of time) of the separating element 7 during one revolution or between two successive separating processes at the time points $t_n$ and $t_{n+1}$. Starting from a first rotational speed $\omega_1$ at a time $t_n$ during the separation of a value document n, the rotation of the separating element 7 is temporarily accelerated to a second rotational speed $\omega_2$ and then braked back down to the first rotational speed $\omega_1$ so that the separating element 7 is once again rotating at the first rotational speed $\omega_1$ at a later point in time $t_{n+1}$ at which the next value document n+1 is withdrawn from the stack. Even if the time profile for the rotational speed ω shown in the present example is essentially trapezoidal, other time profiles are also possible or preferred, such as a sinusoidal, triangular, sawtooth or rectangular profile.

Preferably, the first rotational speed ω1 is selected such that the track speed of the separating element 7 and/or friction element 7' during the separating process or during withdrawal of the corresponding value document from the stack corresponds substantially to the transport speed at which the separated value documents 2' are transported by the transport device 10. This prevents value documents backing up and/or additional wear on the value documents and/or noise emission during the transfer of the value documents to the transport device 10. Typical transport speeds in the transport device 10 are, for example, 1.8 m/s, 2.0 m/s or 2.63 m/s, but can also be less or more.

FIG. 4 shows examples of value documents of different formats separated a) in a conventional manner and b) in accordance with the present disclosure and transported in the transport device 10 in the transport direction T. The upper part of the drawing in each case shows larger format value documents, the lower part of the drawing in each case shows smaller format value documents.

In the case of value documents separated in a conventional manner, the distance D between the leading edge of each of the separated value documents is always the same regardless of the format (cf. the upper and lower parts of FIG. 4*a*) of the value documents and is predetermined by the transport speed in the transport device 10 or by the track speed of the friction element 7' during withdrawal from the stack. For example, the distance D is 15 cm at a transport speed of 17.5 value documents per second. The gaps occurring between the value documents withdrawn successively in this case are correspondingly larger in the case of smaller formats than in the case of larger formats. The achievable throughput (value documents per unit of time) during processing of the value documents is always the same for larger and smaller value documents in this case.

In contrast thereto, in the case of value documents separated according to the present disclosure, the gap L between the successively separated value documents can be targetedly reduced in a simple and reliable manner, in particular during the separating and/or processing of value documents, as illustrated in the lower part of FIG. 4*b*, by temporarily increasing the rotational speed of the separating element 7 or friction element 7' during one revolution in each case. The distance between the leading edge of each of the successively withdrawn value documents is thereby accordingly reduced compared to the situation shown in FIG. 4*a* so that, despite the same transport speed at which the withdrawn value documents are transported in the transport direction T, a higher throughput (value documents per unit of time) can be achieved, in particular in the case of smaller format value documents, during processing of the value documents.

In an application in which a stack of value documents of different formats is to be processed (so-called multi-denomination processing), the temporary increase in the rotational speed of the separating element 7 can preferably be of such a size that the gap occurring between two subsequently separated value documents of the largest format of this currency has a predefinable width, in particular the smallest possible predefinable width (e.g., 10, 20 or 30 mm). This ensures that at least the largest format value documents contained in the stack can be separated and processed with the highest possible throughput. In this case, the dimensions of the largest format value documents thus determine the achievable throughput during processing of the value documents contained in the stack.

In an application in which a stack of value documents of the same format is to be processed (so-called mono-denomination processing), the temporary increase in the rotational speed of the separating element 7 can preferably be of such a size that the gap occurring between two value documents of this format subsequently separated has a predefinable width, in particular the smallest possible predefinable width (e.g., 10, 20 or 30 mm). This ensures that the value documents contained in the stack can be separated and processed with the highest possible throughput.

The above statements apply accordingly to applications in which the gap between the separated value documents is to be increased, wherein in these cases the rotational speed of the separating element 7 is temporarily reduced during one revolution in each case.

The invention claimed is:

1. A device for separating value documents, comprising:

a receiving device which is designed to receive a stack of value documents, a rotatable separating element which is designed to act temporarily on a value document of the stack each time and to withdraw the value document from the stack, and a drive device which is designed to rotate the separating element, wherein a control device which is designed to control the drive device such that a rotational speed of rotational movement the separating element is made to perform by the drive device is changed temporarily, during one revolution of the separating element, wherein the control device is designed to control the drive device such that the separating element rotates at a first rotational speed while the separating element is acting on the value document of the stack and withdrawing the value document from the stack, and, during one revolution in each case, temporarily rotates at a second rotational speed, which is faster or slower than the first rotational speed, wherein the separating element is designed to feed the value documents withdrawn from the stack each time to a transport device arranged downstream of the separating device and configured to transport the value documents at a transport speed, and wherein the first rotational speed is selected such that a track speed of the separating element, while the separating element is acting on the value document of the stack and withdrawing the value document from the stack, corresponds to the transport speed.

2. The device according to claim 1, wherein the control device is designed to control the drive device such that the rotational speed is temporarily increased and/or reduced during one revolution of the separating element in each case.

3. The device according to claim 1, wherein the control device is designed to control the drive device such that the first rotational speed of the separating element is consistent for all value documents that have been or are to be withdrawn.

4. The device according to claim 1, wherein the control device is designed to control the drive device such that the rotational speed of the separating element is periodically changed.

5. The device according to claim 4, wherein the periodic change in the rotational speed of the separating element has a period which corresponds to the time for a complete revolution of the separating element, and/or between two successive separating processes in which one value document is withdrawn from the stack.

6. The device according to claim 1, wherein the control device is designed to control the drive device in such a way that the change in the rotational speed of the separating element during one revolution of the separating element in each case and/or between two successive separating processes in which one value document is withdrawn from the stack has a sinusoidal, triangular, trapezoidal and/or rectangular time profile.

7. A value document processing system comprising one or more devices for processing, transporting, checking, counting and/or sorting, value document comprising a device for separating value documents according to claim 1.

8. A method for separating value documents, the method comprising:

providing a stack of value documents, and using a rotating separating element, temporarily acting on one value document in the stack and withdrawing the one value document from the stack, and, during one revolution of the separating element in each case, temporarily changing a rotational speed of the rotating separating element, wherein the separating element is configured to rotate at a first rotational speed while acting on the one value document and withdrawing the value document from the stack, wherein the separating element is further configured to, during one revolution in each case, temporarily rotate at a second rotational speed, which is faster or slower than the first rotational speed, wherein the separating element is further configured to feed the value documents withdrawn from the stack each time to a transport device arranged downstream of the separating element and configured to transport the value documents at a transport speed, and wherein the first rotational speed is selected such that a track speed of the separating element, while the separating element is acting on the one value document and withdrawing the one value document from the stack, corresponds to the transport speed.

* * * * *